United States Patent [19]

Couper

[11] Patent Number: 4,758,405

[45] Date of Patent: Jul. 19, 1988

[54] POWDER-METALLURGICAL PROCESS FOR THE PRODUCTION OF A GREEN PRESSED ARTICLE OF HIGH STRENGTH AND OF LOW RELATIVE DENSITY FROM A HEAT RESISTANT ALUMINUM ALLOY

[75] Inventor: Malcolm J. Couper, Station Siggenthal, Switzerland

[73] Assignee: BBC Brown Boveri AG, Baden, Switzerland

[21] Appl. No.: 84,184

[22] Filed: Aug. 12, 1987

[30] Foreign Application Priority Data

Aug. 12, 1986 [CH] Switzerland ..... 3230/86

[51] Int. Cl.[4] ..... B22F 1/00

[52] U.S. Cl. ..... 419/33; 75/0.5 C; 75/249

[58] Field of Search ..... 75/249, 0.5 C; 419/33

[56] References Cited

U.S. PATENT DOCUMENTS

| | | | |
|---|---|---|---|
| 2,963,780 | 12/1960 | Lyle et al. | 75/249 |
| 2,967,351 | 1/1961 | Roberts et al. | 75/249 |
| 3,462,248 | 8/1969 | Roberts et al. | 75/249 |
| 4,347,076 | 8/1982 | Ray et al. | 75/249 |
| 4,435,213 | 3/1984 | Hildeman et al. | 75/249 |
| 4,464,199 | 8/1984 | Hildeman et al. | 75/249 |
| 4,647,321 | 3/1987 | Adam | 75/249 |
| 4,661,172 | 4/1987 | Skinner et al. | 75/249 |
| 4,676,830 | 6/1987 | Inumaru et al. | 75/249 |
| 4,702,885 | 10/1987 | Odani et al. | 75/249 |

*Primary Examiner*—Stephen J. Lechert, Jr.

*Attorney, Agent, or Firm*—Oblon, Fisher, Spivak, McClelland & Maier

[57] ABSTRACT

A green pressed article of high strength and of low relative density, formed from a heat-resistant aluminum alloy of the Al/Fe/X or Al/Cr/X type, where X is Ti, Ce, Zr, Hf, V, Nb, Cr, Mo or W, is produced by a powder-metallurgical process, wherein an alloy melt is atomized to form fine particles by means of an inert gas jet, with which 0.5 to 2% by volume of oxygen is admixed, and the powder produced in this manner is compactd. Nitrogen, argon or helium can be employed as inert gas. The green pressed article is preferably formed from a small proportion of coarser, non-spherical particles and a greater proportion of finer, spherical particles.

9 Claims, No Drawings

POWDER-METALLURGICAL PROCESS FOR THE PRODUCTION OF A GREEN PRESSED ARTICLE OF HIGH STRENGTH AND OF LOW RELATIVE DENSITY FROM A HEAT RESISTANT ALUMINUM ALLOY

TECHNICAL FIELD

Heat-resistant aluminum alloys, which are produced from powders obtained with a high rate of cooling by atomization of a melt. A high content of alloy components, e.g. Fe and Cr, which are not acceptable under otherwise conventional solidification conditions.

The invention relates to the production of aluminum alloy powders and the production of pressed articles from these powders.

In particular, it relates to a powder-metallurgical process for producing a green pressed article of high strength and of low relative density, related to the condition without pores, from a heat-resistant aluminum alloy of the Al/Fe/X or Al/Cr/X type, where X may be Ti, Zr, Hf, V, Nb, Cr, Mo or W.

PRIOR ART

Aluminum alloys which are suitable for the production of powders from melts by means of gas-jet atomization with the application of very high rates of cooling ($10^5$°C./s and above) and may be employed for the production of heat-resistant workpieces, have become known in numerous variations. A significant group is represented by the polynary alloys, in most cases exhibiting relatively high iron contents, of the Al/Fe/X type, where X represents at least one of the elements Ti, Zr, Hf, V, Nb, Cr, Mo and W.

In the production of pressed articles, an important part is played inter alia, by the shape and the size distribution of the powder particles. The result is closely associated with the gaseous atomizing agent which is employed.

If an inert gas (N, Ar, He) is employed, then oxidation and the absorption of water and hydrogen are to a large extent suppressed. Spherical particles are predominantly produced.

On the other hand, if air is employed as the atomizing agent, then considerable oxidation and hydration of the powder particles take place. The latter have predominantly elongated and branched irregular, non-spherical shape (cf. J. Meunier, ASTM Symposium on Rapidly Solidified Power Aluminum Alloys, Philadelphia, 1984; Y. W. Kim, W. M. Griffith, F. H. Froes, J. of Metals, August 1985, 27.; G. Stanieck, Aluminum 60, 1984, 3; R. F. Singer, W. Oliver, W. D. Nix, Met. Trans. 11A, 1980, 1985; S. T. Morgan et al. in: M. S. Koczak and G. J. Hildeman, High Strength Powder Metallurgy Aluminum Alloys, 1982, TMS-AIME).

On compaction to form green pressed articles, spherical powders give low mechanical strength, since the particles are deformed only slightly. However, at the same time the density is relatively high, and this impedes degassing and the expulsion of undesired extraneous substances in the course of the further processing. On the other hand, non-spherical powders give green articles of high strength, combined with low density. However, in this case the content of substances to be degassed (oxygen, water, hydrogen) is high.

It is evident from what has been stated above that powder production in accordance with the known methods leaves something to be desired, with regard to the target properties of the finished workpieces. Either the mechanical strength of the green pressed articles is too low or their contents of included harmful substances are too high. In the course of the further processing, both lead to workpieces with inadequate strength properties, which are at least not compatible with the target values.

Accordingly, there is a great need for an improvement of the processes for producing powders, which lead to improved end products.

DESCRIPTION OF THE INVENTION

The object of the invention is to provide a process for producing an aluminum alloy powder by atomization of a melt, which process gives, on compaction a green pressed article with the greatest possible strength and, at the same time, a low relative density (related to the theoretical maximum value of 100%).

This object is fulfilled in that, in the process initially mentioned, an appropriate alloy melt is atomized to form fine particles by means of a gas jet consisting of an inert gas, with which 0.5 to 2% by volume of oxygen is admixed, and in that the powder produced in this manner is compacted.

In this connection, it is pointed out that the complete removal of the water and of the hydrogen from the hydrolyzed $Al_2O_3$ surface layers of the powder particles at approximately 400° C. during the degassing process proceeds more rapidly in the case of the application, according to the invention, of an atomizing gas, doped with oxygen, in the course of the powder production, than in the case of conventional atomization with air.

MODE OF IMPLEMENTING THE INVENTIONC

The invention is explained with reference to the exemplary examples which follow:

EXAMPLE I

An aluminum alloy of the following composition was melted:

Fe=9% by weight
V=3.5% by weight
Al=remainder.

The melt was atomized in a device by means of a gas stream, to form a powder having a maximum particle diameter of 50 μm. Inert gases (nitrogen, argon) with and without the addition of oxygen were employed as atomizing gases.

A few hundred grams of the powder were filled into a rubber bag, sealed and compacted while cold. A cylindrical test specimen having a diameter of 20 mm and a height of 30 mm was formed from the green pressed article and subjected to a pressure test. In the same way, the respective density related to the theoretical value was determined.

It can be shown that, at a comparatively lower density, the green pressed articles produced from powders with the addition of oxygen exhibit substantially higher strengths than those produced from powders without the addition of oxygen (pure inert atomizing gases).

EXAMPLE II

An alloy of the following composition was melted:

Fe=8% by weight
V=2% by weight
Al=remainder.

In a similar way to Example I, the melt was atomized in various ways to form a powder, and was subsequently compacted. Specimens for the determination of the compressive strength and of the relative density were formed from the pressed article. The results are as follows:

| Atomizing gas: | Compaction pressure (bar) | Compressive strength (MPa) | Relative density (%) |
|---|---|---|---|
| Nitrogen | 1000 | 0.6 | 72 |
| Nitrogen | 2500 | 10 | 80 |
| Nitrogen + 2% by volume $O_2$ | 1000 | 12 | 69 |
| Nitrogen + 2% by volume $O_2$ | 2500 | 120 | 82 |

EXAMPLE III

An alloy of the following composition was melted:
Fe=8% by weight
Mo=2% by weight
Al=remainder.

It was not possible to produce a pressed article by cold pressing from the powder produced with inert gas.

| Atomizing gas: | Compaction pressure (bar) | Compressive strength (MPa) | Relative density (%) |
|---|---|---|---|
| Argon | 1000 | | |
| Argon + 1% by volume $O_2$ | 1000 | 12 | 69 |
| Argon + 1% by volume $O_2$ | 3000 | 120 | 82 |

The green pressed articles of the above exemplary embodiments were also subjected to a degassing process. In this connection, it became evident that the degassing times of the powders produced with inert atomizing gas with the addition of oxygen were between those with inert atomizing gas and those with air. Advantageously, the green pressed articles should be degassed for a period of 1 to 10 h at a temperature of 350° to 400° C. prior to the final thermomechanical processing (hot pressing, extrusion), in which they reach their full, 100% density.

The invention is not restricted to the exemplary embodiments. It may, in principle, be applied to all heat-resistant aluminum alloys of the Al/Fe/X to Al/Cr/X type, where X represents Ce, Ti, Zr, Hf, V, Nb, Cr, Mo or W.

The atomizing gas may be an inert gas such as nitrogen, argon or helium, with which 0.5 to 2% by volume of oxygen is admixed. It may also be a mixture of at least two of the abovementioned gases.

The process is preferably conducted in such a manner that in the first step (atomization in the gas stream) a powder is produced, which contains relatively small proportions of coarser, non-spherical particles and relatively high proportions of fine, spherical particles. This can be achieved by appropriate choice of the gas composition, especially of the addition of oxygen.

I claim:

1. A powder-metallurgical process for producing a green pressed article of high strength and of low relative density, related to the condition without pores, from a heat-resistant aluminum alloy of the Al/Fe/X or Al/Cr/X type, where X may be Ti, Ce, Zr, Hf, V, Nb, Cr, Mo or W, wherein an appropriate alloy melt is atomized to form fine particles by means of a gas jet consisting of an inert gas, with which 0.5 to 2% by volume of oxygen is admixed, and wherein the powder produced in this manner is compacted.

2. The process as claimed in claim 1, wherein nitrogen, argon or helium or a mixture of at least two of these gases is employed as said inert gas.

3. The process as claimed in claim 1, wherein in the first step a powder is produced, which contains relatively small proportions of coarser, non-spherical particles and relatively high proportions of fine, spherical particles.

4. The process as claimed in claim 1, wherein the green pressed article is degassed for a period of 1 to 10 h at a temperature of 350° to 400° C.

5. The process of claim 1, wherein said inert gas comprises nitrogen.

6. The process of claim 1, wherein said inert gas comprises argon.

7. The process of claim 1, wherein said inert gas comprises helium.

8. The process of claim 1, wherein said aluminum alloy is of the Al/Fe/X type.

9. The process of claim 1, wherein said aluminum alloy is of the Al/Cr/X type.

* * * * *